US006484707B1

(12) United States Patent
Frus et al.

(10) Patent No.: US 6,484,707 B1
(45) Date of Patent: Nov. 26, 2002

(54) METHOD AND APPARATUS FOR GENERATING A SUSTAINED ARC AT A SPARKING DEVICE

(75) Inventors: John R. Frus, Jacksonville, FL (US); Michael J. Cochran, Jacksonville, FL (US)

(73) Assignee: Unison Industries, Inc., Jacksonville, FL (US)

( * ) Notice: Subject to any disclaimer, the term of this patent is extended or adjusted under 35 U.S.C. 154(b) by 0 days.

(21) Appl. No.: 09/676,220

(22) Filed: Sep. 29, 2000

(51) Int. Cl.[7] ..... F02P 3/02
(52) U.S. Cl. ..... 123/620; 123/597
(58) Field of Search ..... 123/597, 620, 123/605, 146.5 R, 149 C, 149 D, 149 F; 315/209 CD

(56) References Cited

U.S. PATENT DOCUMENTS 3,569,727 A 3/1971 Aggarwal
3,788,293 A 1/1974 Anderson
3,835,830 A 9/1974 Shepherd
4,223,656 A * 9/1980 Hamley ..... 135/598
4,983,886 A 1/1991 Balland
5,115,793 A * 5/1992 Giaccardi et al.
5,215,066 A * 6/1993 Narishige et al. ..... 123/620
5,245,252 A * 9/1993 Frus et al. ..... 315/209 R
5,347,422 A 9/1994 Smith et al.

* cited by examiner

*Primary Examiner*—Gene Mancene
*Assistant Examiner*—Mahmoud Gimie
(74) *Attorney, Agent, or Firm*—Leydig, Voit & Mayer, Ltd

(57) ABSTRACT

An apparatus is described for generating a sustained arc at a spark-generating device. A power converter charges an energy storage device to a voltage that will ionize an air gap of a spark device such as an igniter plug. After the voltage is applied to the spark device, the air gap is ionized and the energy from the energy storage device has been exhausted, energy continues to be supplied to the gap by the converter for a predetermined time period.

19 Claims, 4 Drawing Sheets

METHOD AND APPARATUS FOR GENERATING A SUSTAINED ARC AT A SPARKING DEVICE

CROSS-REFERENCE TO RELATED PATENT APPLICATIONS

This patent application is related to copending U.S. patent application Serial No. 09/677,079 to Mike Cochran and John Frus, entitled Method and Apparatus For generating High Voltage, and filed Sep. 29, 2000, which is hereby incorporated by reference in its entirety.

FIELD OF THE INVENTION

This invention relates generally to ignition systems, and more specifically to a method and apparatus for generating a sustained arc at a sparking device.

BACKGROUND OF THE INVENTION

Many types of spark ignition systems are known in the art. Such prior art ignition systems generally create sparks of very short duration but with relatively high peak power. In two predominant system types, substantially all of the energy to be discharged is stored in either an inductance coil or a capacitor and then discharged rapidly to create the spark. The later system type, called Capacitive Discharge (CD) ignition is more prevalent than the former type for high-energy spark applications because capacitors are more volumetrically efficient at storing energy than inductors in most practical circumstances.

In either type of system, the typical sequence of operation is: charge an energy storage device; discharge that energy rapidly through a switch to a sparking device; and wait for a predetermined period of time before repeating the charge cycle to generate successive sparks. These three events have relatively different times associated with them. Generally, the charge cycle is accomplished in a few ten's of milliseconds. The discharge event is instantaneous in comparison, lasting only a few hundred microseconds. The inter-spark time delay, on the other hand, is typically several times longer than the charge time. The short spark duration is a result of the RC (Resistance*Capacitance) time constant of the discharge circuit. Once ionized, the plasma presents a very low resistance, on the order of tens to hundreds of milliohms, so even for large values of capacitance the time constant, R*C, is still short. The time constant is defined as the time required for 63.2% of the initial voltage stored in the capacitor to be depleted. The energy (E) stored in a capacitor can be defined by the equation $E=\frac{1}{2}*C*V^2$, so once the voltage has fallen by 63.2%, (i.e., to 36.8% of its initial value), only 13% of the energy initially stored in the energy storage device remains. In other words, the spark is nearly over after just one time constant.

It is desirable to increase the energy delivered by the spark to the fuel mixture in order to promote ignition. It may also be beneficial to lengthen the duration of the spark because there is also a thermal transfer time constant associated with heating the fuel droplets. For an extremely short duration spark, the spark may terminate before sufficient thermal transfer can be completed such that ignition fails to occur.

Once a plasma has been formed, it can be heated by forcing a current (I) through its resistance (R). The power (P), delivered substantially as heat, is $P=I^2*R$, and the total energy delivered is the accumulation, or integration, of that power over time. The requirements to ionize a spark generating device and to sustain a plasma at that same device are very different. Ionization requires a high voltage to overcome the circuit discontinuity presented by the gap of the sparking device, but only a small current is required, and for a short time. Conversely, sustaining the plasma requires a lower voltage because the ionized plasma has a very low impedance, but a higher current is needed, and for a significantly longer time, to transfer any substantial amount of energy to the arc to promote ignition.

Circuits which strike (initiate) an arc and subsequently maintain it with additional energy input are known in the art. U.S. Pat. No. 3,788,293 discloses a circuit in which a sparking device is ionized by a pulse from a high voltage ignition coil associated with a transformer, and then sustained by the discharge of a capacitor also connected to the sparking device. The current from the capacitor does not have to pass through the transformer. Similarly U.S. Pat. No. 3,835,830 describes a circuit which first generates an extra-high voltage pulse to strike an arc, and then maintains the current through the spark generating device using the discharge of a high voltage capacitor which delivers its current through a series connected winding of the same transformer that generates the initial extra-high voltage pulse.

Both of these circuits suffer from certain disadvantages. For example, in both of these circuits a high voltage is present at the sparking device before the intended sparking time. Because of this condition, in many applications, these circuits will not work reliably. They only work with high tension sparking devices, and are rendered inoperable by fouling which presents a shunt impedance across the gap of the sparking device. Low-tension sparking devices which inherently present a shunt impedance before ionization, and high tension plugs, if severely fouled with deposits that create a conductive path, will not always function correctly with these circuits.

Following ionization, both of the aforementioned circuits deliver energy to the plasma from a capacitor. Thus, the flow of energy is a decaying function; most of the energy is delivered quickly following ionization, after which the flow of energy to the plasma gradually diminishes until it is zero. Thus, neither of these circuits is capable of delivering a sustained current to the spark-generating device.

SUMMARY OF THE INVENTION

It is a general object of the invention to provide an improved apparatus for generating a sustained arc at a sparking device. It is a more specific object to provide an apparatus for initiating and sustaining a plasma across the gap of a spark generating device in order to deliver sufficient energy to a fuel mixture to ensure its ignition.

It is another object of the invention to eliminate the large tank capacitor employed in conventional high-energy CD ignition systems, while providing increased energy to the sparking device. It is a related object to provide such a device wherein the increased energy is provided by pumping energy for a longer time, rather than by increasing the value of the tank capacitor to thereby increase the stored energy.

It is another object of the invention to provide improved ignition by lengthening the duration of the spark while maintaining its energy and heat at a high level.

It is a related object of the invention to control the total energy in a spark by controlling the time duration of the sustained pumping of energy into the plasma.

It is another object of the invention to vary the level of pumping of energy through the plasma during a particular cycle to shape the electrical waveform, and consequently affect the physical characteristics of the arc to improve ignition. It is a related object of the invention to control the total energy in a spark by controlling the average current during the interval of sustained pumping of energy into the plasma.

It is yet another object of the invention to reduce wear on the spark-generating device by controlling the timing of pumping of energy to coincide with the varying physical position of the plasma arc.

It is still another object to provide ignition control adaptive to the sensed or predicted needs of the combustor by controlling the total energy on a spark-by-spark basis, responsive to the immediate conditions that affect the probability of successful ignition.

The present invention accomplishes the foregoing and other objectives by providing an apparatus which generates an ionizing pulse to a spark generating device and, as soon as a plasma forms across an air gap of the device, begins controlled pumping of energy into the arc to sustain it, heat it, and deliver energy sufficient to cause ignition.

In accordance with one aspect of the invention, the pumping of energy is an active process rather than the prior passive process of simply dumping a previously stored quantity of energy.

In accordance with another aspect of the invention, the same energy converter pumps energy to the spark generating device to sustain the arc and provides the energy for the ionizing pulse that starts the arc.

It is another aspect of the invention to utilize dual intermittent converters operating alternately to ensure the uninterrupted flow of energy to the arc so that it does not extinguish during the intermittencies of either converter.

It is another aspect of the invention that the delivery of energy to the sparking device is not a decaying function such as would be provided by a conventional capacitive discharge.

It is a related aspect of the invention to deliver the energy according to a predefined function that is not a constant during the period of the pumping of energy.

It is yet another aspect of the invention to respond to a commanded level or total quantity of energy by varying the pumping of energy. In a related aspect of the invention, the apparatus contains a predefined response pattern. In yet another related aspect, the response pattern is created by sensing the instant conditions and calculating the appropriate level and quantity of energy.

In accordance with another aspect of the invention, the sustaining of the arc is terminated at the time when a sensing apparatus determines that ignition has occurred.

In accordance with yet another aspect of the invention, the pumping of large amounts of energy into the arc is deferred until the center of the plasma has moved away from the tip of the spark generating device to reduce wear on the spark generating device.

These and other features and advantages of the invention will be more readily apparent upon reading the following description of the preferred embodiment of the invention and upon reference to the accompanying drawings wherein:

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
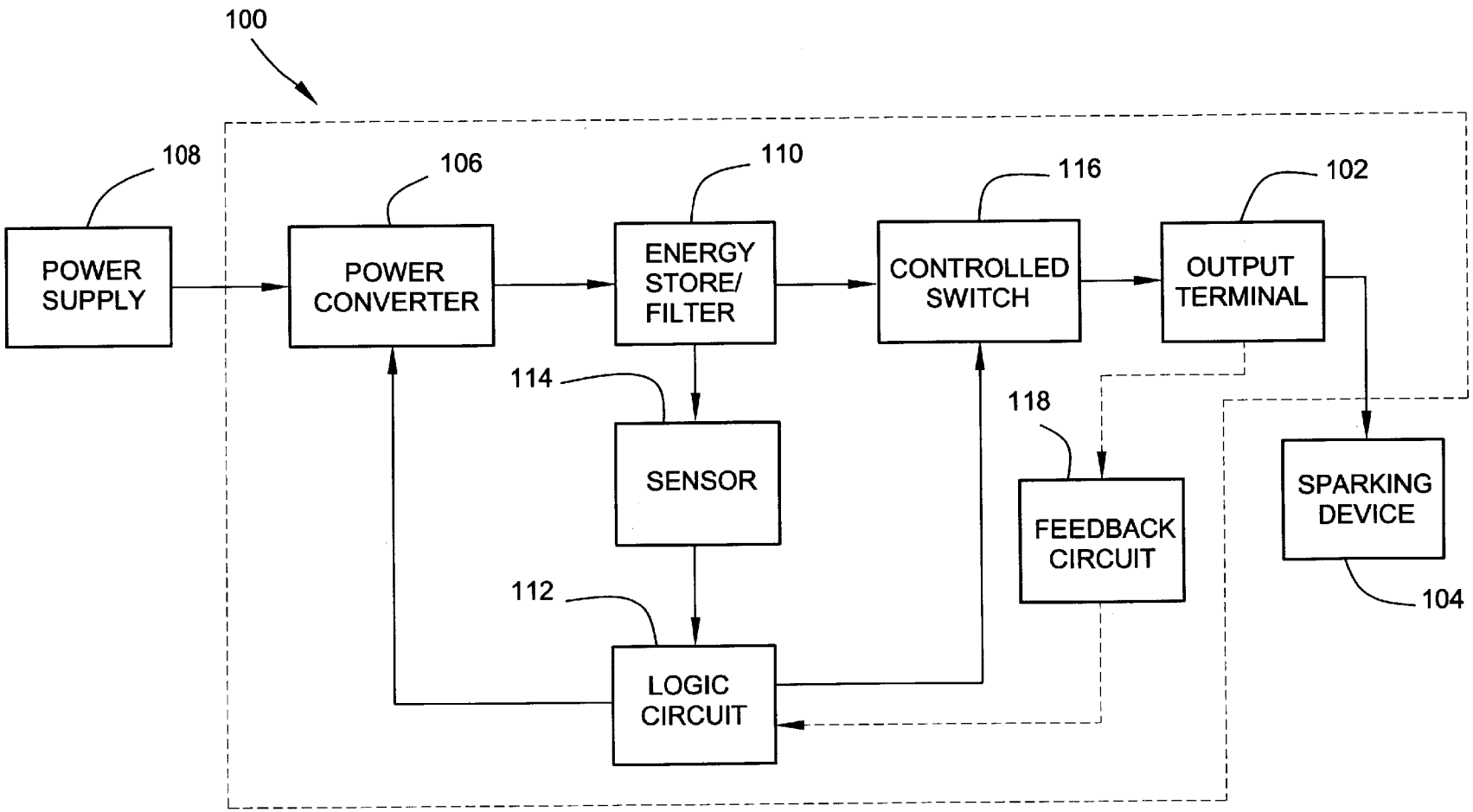
FIG. 1 is a schematic diagram of an apparatus constructed in accordance with the teachings of the instant invention for generating a sustained arc at a sparking device.

FIG. 1 illustrates in a block diagram form an apparatus incorporating the invention. Many of the functional blocks in the diagram are typical of those found in conventional ignition exciters. This description will not dwell on the operation of these blocks, which is well understood by those skilled in the art of ignition systems. Theses conventional blocks are illustrated only to provide a context for the description of the invention.

Although the invention is discussed herein in the context of ignition systems, the invention is also applicable to other applications in which it is beneficial to control the characteristics of an electric arc. For example, the invention is applicable to plasma cutting and plasma deposition. It will, therefore, be appreciated that there is no intention to limit the invention to any specific context or application but, on the contrary, the intention is to cover all applications of the invention falling within the scope of the appended claims.

Returning to the description of FIG. 1, an apparatus 100 generates a controlled arc in a sparking device 104. To this end, the apparatus 100 is provided with an output terminal 102 that couples to the sparking device 104, which may be an igniter plug. The output terminal 102 thus serves to electrically couple the apparatus 100 to the sparking device 104.

In order to provide the apparatus 100 with a source of power, the apparatus further includes a power converter 106, which is specifically designed to connect to a power supply 108. The power converter 106 is preferably designed to condition the power received from the power supply 108 to ensure the apparatus 100 acts in a predetermined fashion and is not affected by fluctuations in the voltage or current from the power supply 108.

For the purpose of initiating a sparking event at the sparking device 104, the apparatus 100 is further provided with an energy storage device 110. The energy storage device 110 is preferably a tank capacitor designed to store small amounts of energy. As explained in further detail below, the purpose of the energy storage device 110 is to provide an initial voltage to the output terminal 102 sufficient to ionize an attached sparking device 104. In accordance with one aspect of the invention, the energy storage device 110 stores enough energy to ionize the sparking device 104, but not as much energy as typically stored in tank capacitors for conventional capacitive discharge systems. For example, in a one joule conventional CD ignition system, the entire one joule must be present in the tank capacitor when discharge is initiated. In this invention, however, only a portion, e.g., 10 percent, of the total spark energy must be stored in the tank capacitor because the sustained arc current will account for the remaining energy required for the arc to perform its task (e.g., cause ignition). The energy stored in the energy storage device 110 is preferably delivered in the form of a relatively high voltage and a relatively low current.

For controlling the operation of the apparatus 100, a logic circuit 112 is provided. The logic circuit 112 has an associated sensor 114 that monitors the energy accumulated in the energy storage device 110. When the sensor 114 senses an appropriate level of energy at the energy storage device 110, the logic circuit 112 will initiate a sparking event. To this end, the logic circuit 112 is coupled to a controlled switch 116 that is connected in circuit with the output terminal 102 and the energy storage device 110. Thus, when the sensor 114 indicates sufficient energy to ionize the sparking device 104 has accumulated in the energy storage device 110, the logic circuit 112 closes switch 116, thereby providing an electrical path for the energy stored in the energy storage device 110 to the output terminal 102 and the sparking device 104, which causes the plug of the device to ionize an air gap.

In accordance with an important aspect of the invention, once the sparking device 104 has created an ionized air gap, the power converter 106 continues to pump energy to the output terminal 102 for a determined length of time, which generates a controlled arc having known characteristics at the spark-generating device 104. This sustained pumping of energy results in a very different arc at the spark-generating device 104 than is developed by conventional ignition systems. Unlike conventional capacitive discharge systems, the energy delivered to the sparking device 104 need not decay exponentially. On the contrary, the power converter 106 is controlled to sustain an arc at the spark-generating device at a substantially constant intensity for whatever length the user desires. Alternatively, the output of the power converter 106 is varied over time to controllably vary the characteristics of the arc at the sparking device 104, including its intensity, plume-shape, and duration.

To control the length and characteristics over time of the output from the power converter 106, a logic circuit 112 is coupled to the power converter 106. In the simplest embodiment of the invention, the logic circuit 112 switches the power converter 106 between on and off states to control the duration of the arc at the sparking device 104. In this embodiment, the arc generated at the sparking device 104 has a substantially uniform intensity. However, in other embodiments of the invention, the logic circuit 112 varies the output of the power converter 106 according to a function that represents the desired characteristics of the arc (e.g., intensity, duration, and/or plume-shape).

In accordance with a further aspect of the invention, the apparatus 100 is optionally provided with a feedback circuit 118 to provide the logic circuit 112 with information concerning the time-varying characteristics of the arc at the sparking device 104. In this optional embodiment, the logic circuit 112 varies the output of the power converter 106 to ensure an arc having desired characteristics is generated at the sparking device 104.

Figure 4:
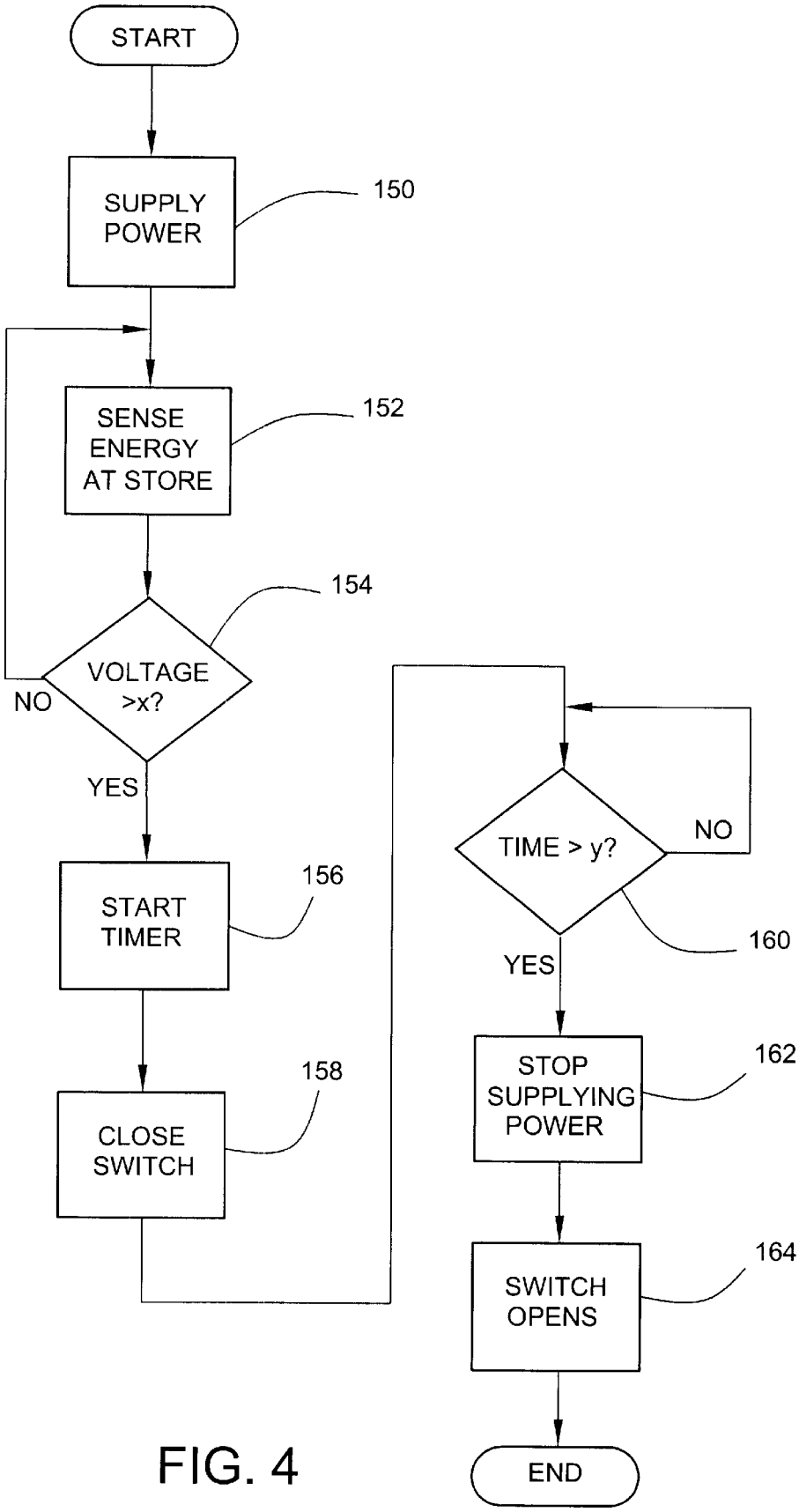
FIG. 4 is a flow diagram illustrating the steps associated with one embodiment of the inventive method for generating a sustained arc at a sparking device.

The general operation of the apparatus 100 during a complete ignition cycle is explained hereinafter in the context of the flow chart of FIG. 4. In particular, an ignition cycle begins with the application of power to the energy storage device at step 150. Then, at 100 steps 152 and 154, the energy storage device 100 continues to accumulate energy until the sensor 114 determines that the stored energy is sufficient to ionize an air gap at a sparking device 104 coupled to the apparatus.

Once the sensor determines that sufficient energy is stored at the energy storage device, a timer is initiated at step 156 and the switch 116 is opened at step 158, which connects the energy storage device 110 to the output terminal 102. As a result of this connection, the energy stored in the energy storage device 110 develops a sufficient voltage at the sparking device 104 to develop a plasma across the air gap. Since the power converter 106 continues to pump energy through the apparatus after the plasma has appeared across the air gap of the sparking device 104, the current from the power converter 106 sustains the arc of the plasma. The power converter continues to pump energy into the sparking device 104 and through the arc until a predetermined time has elapsed, as indicated at step 160, which is determined by the timer.

To end the spark event, at step 162, the logic circuit 112 (e.g., the trigger and timer circuits 9 and 11 of FIG. 2) causes the power converter 106 to turn off, which then stops the flow of energy from the converter to the sparking device 104 and the controlled switch 116 opens at step 164. Preferably, the switch 116 comprises four SCRs connected in a series that automatically open when the power converter 106 is switched off. At this point, a complete cycle of a spark event has occurred. If desired, the process can be repeated to produce multiple sparks at the sparking device 104.

Figure 2:
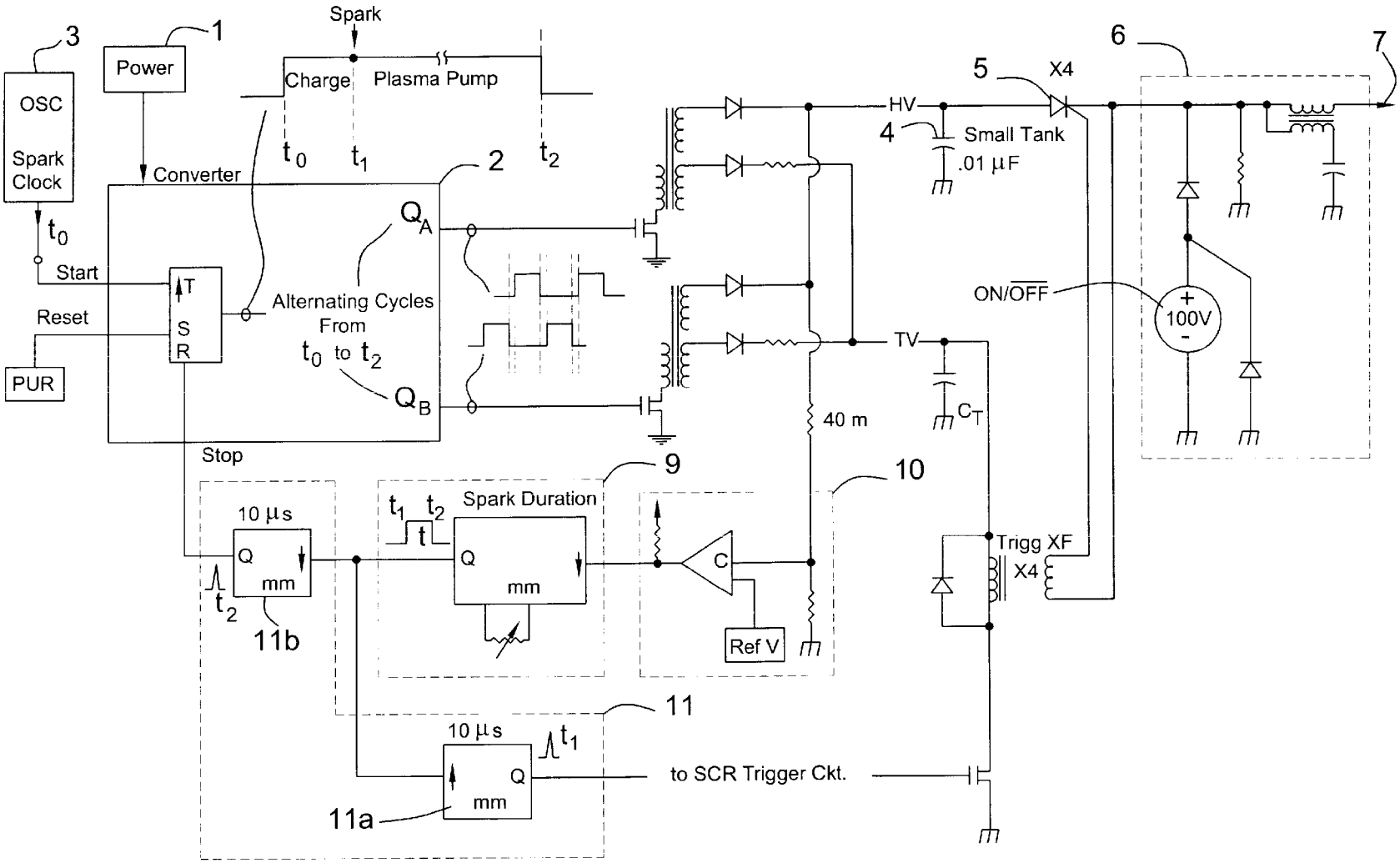
FIG. 2 is a circuit diagram illustrating a preferred embodiment of the invention.

Turning to the specific embodiment illustrated in FIG. 2, an energy converter 2 receives input power from an external source 1, typically a battery or generator producing regulated power. The energy converter 2 is preferably an interleaved flyback converter as described in co-pending U.S. patent application No. 09/677,079 to John Frus and Michael J. Cochran, filed Sep. 29, 2000, which application is hereby incorporated by reference in its entirety. Upon receipt of a start signal that originates at spark clock 3 (e.g., any source, depending upon the application, but a simple oscillator is an example), the converter 2 begins transforming the input power into a voltage appropriate for ionizing a gas or mixture. This is generally a high voltage (e.g., on the order of one or more kilovolts), and may be accumulated by a small capacitor 4 (e.g., a 0.01 $\mu$F capacitor). Capacitor 4 is also connected to a switch 5 that has a high impedance (off) state that temporarily prevents delivery (leakage) of energy to an output network 6 and via an external connection 7 which is typically an ignition lead, to a spark generating device such as a conventional semiconductor plug (not shown).

After power is applied to the system, in the illustrated embodiment, the start pulses from spark clock 3 are generated periodically. However, those skilled in the art of ignition systems will appreciate that these pulses can instead originate at an external device such as an electronic engine control or system computer, and may be non-periodic. In either case, the pulses serve to begin the conversion cycle that pumps energy into capacitor 4 and eventually into the plasma arc formed at the air gap of the spark-generating device—e.g., an igniter plug for a turbine engine.

The switch 5 is preferably a solid-state switch such as a silicon-controlled rectifier. The operation of such a switch is described in detail in U.S. Pat. No. 5,245,252, which is hereby incorporated by reference in its entirety. Those skilled in the art of ignition systems will appreciate, however, that other types of switches such as triggered-spark-gaps could be employed instead of the solid state switch without departing from the spirit and scope of the invention. In any event, in the preferred embodiment four SCRs connected in series comprise switch 5.

The solid-state switch 5 is activated, (i.e., caused to switch to its low impedance (on) state), at the appropriate time by a trigger circuit 9, which as illustrated is implemented as a simple one-shot, flip-flop circuit of conventional design. In the preferred embodiment of FIG. 2, the trigger circuit is responsive to a sensor circuit 10 that monitors the voltage on capacitor 4. The capacitor 4 is not equivalent to the tank capacitor in a conventional capacitive discharge (CD) ignition system, which stores large amounts of energy. Instead, the capacitor 4 has a small capacitance that allows the accumulation of a sufficient voltage to ionize the air gap of the igniter plug but stores only a small amount of energy.

Sensor circuit 10, comprised of a operational amplifier and a reference voltage source as illustrated in FIG. 2, triggers the solid-state switch 5 when a voltage sufficiently high to ensure ionization of the air gap of the sparking device has been accumulated by capacitor 4. As those skilled in the art of ignition systems will appreciate, the precise value of the voltage depends on the characteristics of the sparking device. Sensor circuit 10 simultaneously triggers a timer circuit 11 that determines the length of time after the trigger event (which causes ionization) during which the converter circuitry 2 continues to run, thus pumping energy into the plasma arc. In the illustrated embodiment of FIG. 2, the timing circuit 11 comprises two conventional edge-triggered flip-flop circuits 11*a* and 11*b*, where the flip flop 11*a* outputs a pulse on the rising edge of the ouput from the trigger circuit 9 and the flip flop 11*b* outputs a pulse on the falling edge of the output from the trigger circuit 9.

This operating cycle of the ignition device illustrated in FIG. 2 is contrary to the operating cycle of a conventional CD ignition. In those conventional ncircuits, the converter typically ceases to run for a period of time prior to or immediately after the trigger event. Thus, all of the energy in a conventional CD ignition must be stored prior to the trigger event. In contrast, in the embodiment of the invention illustrated in FIG. 2 most of the energy delivered to the arc at the air gap of the igniter plug is generated by the converter after the trigger event has ionized the gap and a plasma has formed.

An output pulse is generated by timer 11 at the end of its preset time period. This pulse is applied to the stop input of converter 2 and terminates the pumping of energy by this converter, which quenches the arc. The operating cycle of converter 2 has two distinct phases. The first phase begins at time t0 when the spark clock initiates a cycle, and ends at time t1 when sensor 10 and trigger circuit 9 causes the trigger event. The second phase begins at t1 (the trigger event) and ends at t2 when timer 11 completes its preset interval. Unlike previous ignition systems that generally have a fixed energy spark, the energy delivered to the arc of the instant invention can be varied simply by extending or reducing the preset value of timer 11. Changing the preset modifies the time interval (t2-t1) during which the arc receives energy from converter 2 which heats and sustains the plasma. The longer this interval, the more total energy is transferred to the arc.

Figure 3:
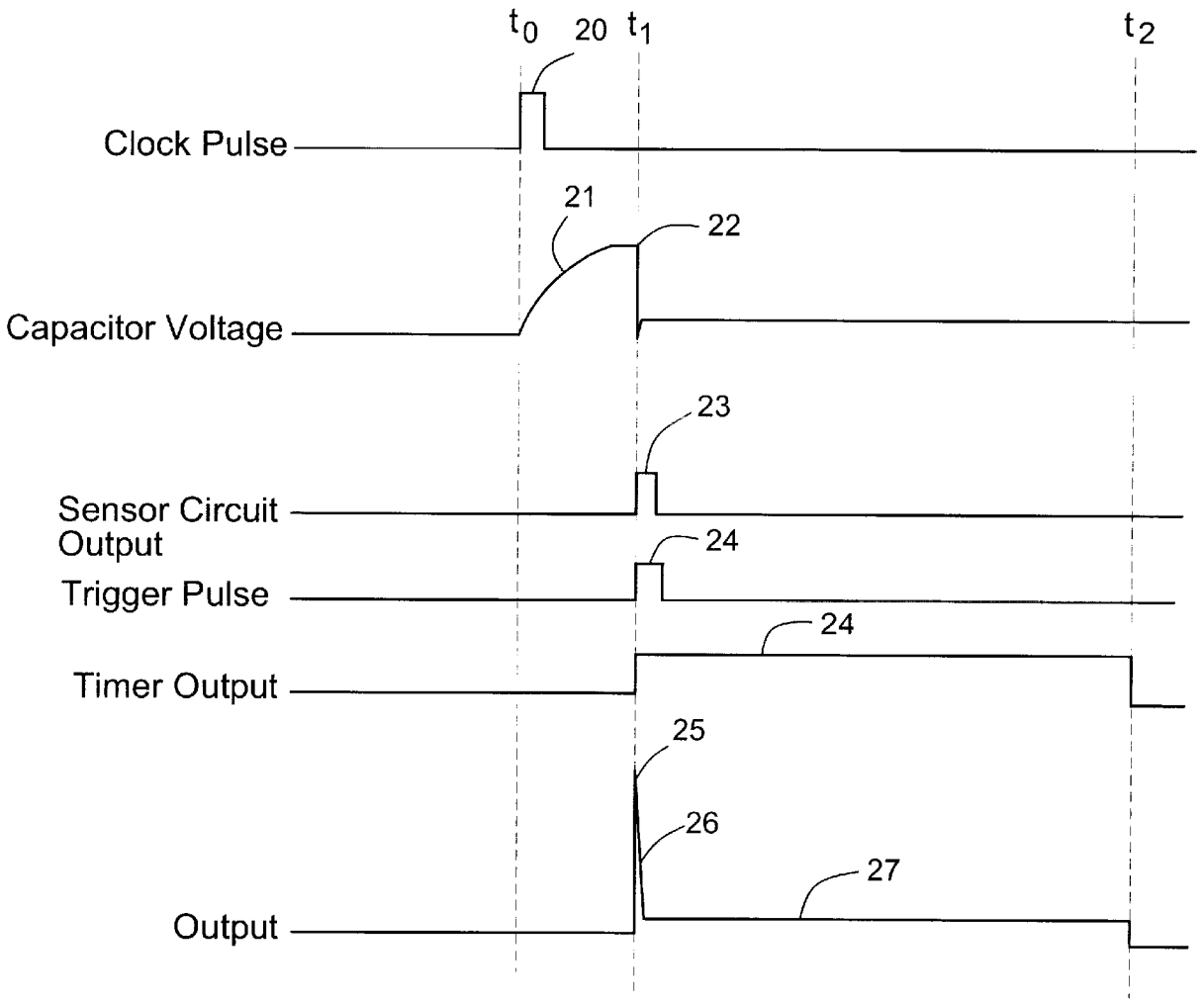
FIG. 3 is a timing diagram of the typical voltage and current delivered to the sparking device by the apparatus of FIG. 1.

FIG. 3 shows a timing diagram illustrating the operation of the embodiment illustrated in FIG. 2. A clock pulse 20, occurring at t0, from the spark clock or external source initiates an ignition cycle. This starts the converter 2 that begins pumping energy, and a voltage 21 builds up at the capacitor 4 as the converter operates, reaching a threshold level 22 at time t1 that is detected by the sensor circuit 10. The sensor circuit output 23 changes state to signal that the system is ready to generate an ionizing pulse. The output 23 causes trigger pulse 24 that activates the switch 5 and produces a high voltage pulse 25 at the spark-generating device. The output 23 also starts a timer that produces output 24, a pulse with width (t2-t1). The rising edge of pulse 24 does not stop the converter. The trailing edge 26 of the high-voltage pulse 25 falls rapidly toward zero as the plasma forms and drains the small amount of stored energy from the energy storage device 4. Unlike the operation of conventional CD ignition systems, instead of falling to zero, the voltage reaches a plateau 27. The plateau voltage is the product of energy from the converter 2, causing current to flow through the low resistance plasma. In FIG. 3 the plateau is flat, which represents the most basic performance of the instant invention. As will be explained later with reference to an alternative embodiment, varying the pumping alters the shape of plateau 27.

Absent any further control signals, however, the converter 2 will continue to run, sustaining the plateau 27, and the plasma arc, for an indefinite period of time. In certain ignition applications this may be a useful operating mode, however, in the illustrated embodiment, referring again to FIG. 3, the timer output 24 again changes state at time t2 and its falling edge signals the converter 2 to stop pumping energy. This has the immediate effect of terminating the arc and plateau 27. Thus, time t2 is the end of one ignition cycle. The cycle, encompassing the interval from time t0 through time t2, may be repeated or may exist independently as the complete ignition event without departing from the spirit and scope of the invention.

In a typical combustor application, intermittent, repetitive sparks are used to ignite the fuel mixture. In the ideal case, one spark will light the mixture if conditions are right. These conditions include airflow, mixture-ratio, temperature, pressure, atomization quality, and other variables. During the ignition event, these conditions are continuously changing. Conventional sparks, however, are short transient events which are discontinuous and are present for only a minute percentage of the time; and a spark at an inappropriate instant cannot light the mixture at all. To solve this problem either an increased energy-per-spark, a higher spark rate, or both, is utilized to provide increased opportunity to ignite the combustion. Increasing the number of spark events increases the probability that an event will occur synchronously with the exact conditions for ignition. Increasing the energy of each spark has been a common approach; this brute force method attempts ignition regardless of whether the conditions are optimal for successful ignition. Although ignition may improve with increased energy, the spark duration is still short, generally on the order of hundreds of microseconds, and ignition may fail.

Increasing either the energy or rate of ignition sparks or arcs carries the same size, weight and cost penalties. In the instant invention, improved control of the energy waveform in an ignition arc aimed at optimizing the coupling of the energy into the fuel mixture provides better ignition without the penalties the conventional techniques of increasing rates or energy levels of the sparcks.

In an alternative embodiment of the invention, in addition to the basic circuitry of the embodiment illustrated in FIG. 2, a programmed controller controls of energy delivery and feedback of waveforms associated with the plasma arc. For simplicity, the logic is implemented using a single microcontroller, although one skilled in the art of ignition systems will realize that the functions can be accomplished with discrete digital or analog logic integrated circuits. The microcontroller is programmed to execute a sequence of events, including sensing input signals and modulating output signals at precise times under the control of an accurate clock. Since these devices and their associated programming techniques are well known in the art, the details are not be discussed herein.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. An apparatus for generating a sustained arc at a spark generating device comprising:

an output terminal connecting to a spark generating device;

a power converter having on and off states for selectively supplying energy to the spark generating device connected to the output terminal;

an energy storage device for storing a voltage sufficient to ionize an air gap of the spark generating device;

a switch for selectively transferring the voltage at the energy storage device to the spark generating device by way of the output terminal;

a sensor associated with the energy storage device that monitors an amount of energy stored by the energy storage device; and, a logic circuit connected to the sensor, the switch, and the power converter for (1) switching the switch to a conducting state so that the energy stored in the energy storage device ionizes the air gap of the spark generating device, (2) controlling the power converter to pump energy to the output terminal to sustain a plasma arc at the air gap of the connected spark generating device for a predetermined time period after which the logic circuit switches the power converter to its off-state.

2. The apparatus of claim 1 wherein the spark-generating device is an igniter plug.

3. The apparatus of claim 1 wherein the power converter comprises a switching power supply.

4. The apparatus of claim 1 wherein the power converter comprises dual intermittent converters operating alternately to ensure an uninterrupted flow of energy to the arc.

5. The apparatus of claim 1 wherein the energy storage device comprises a capacitor.

6. The apparatus of claim 1 wherein controlled switch comprises a silicon-controlled rectifier.

7. The apparatus of claim 1 wherein the logic circuit comprises a microprocessor.

8. The apparatus of claim 1 wherein the logic circuit comprises a trigger circuit and a timing circuit.

9. The apparatus of claim 8 wherein the timing circuit comprises two timers and one of the timers initiates the arc event by closing the switch and the other timer terminates the arc event by switching the power converter to its off-state.

10. The apparatus of claim 1 wherein the power converter charges the energy storage device.

11. The apparatus of claim 1 wherein the energy delivered to the output terminal by the energy storage device and the power converter increases for a time period after ionization of the air gap.

12. The apparatus of claim 1 wherein the logic circuit controls the delivery of energy to the output terminal by the power converter in accordance with a predefined function.

13. The apparatus of claim 1 further comprising a feedback circuit that enables the logic circuit to monitor the arc generated at the spark-generating device.

14. The apparatus of claim 1 wherein the logic circuit limits the energy delivered to the output terminal by the power converter until a center of the plasma arc generated at the air gap of the spark-generating device moves away from a tip of the spark generating device.

15. An apparatus for generating an arc at a spark generating device comprising:

an output terminal connected to a spark-generating device;

an ionizing circuit for developing a voltage to ionize the spark-generating device;

a switch connected to the ionizing circuit and the output terminal that when closed provides an electrically conductive path to communicate the voltage to the output terminal, which ionizes an air gap of the spark-generating device;

a power supply having on and off states for supplying energy to a spark generating device coupled to the output terminal; and, a logic circuit connected to the switch and the power supply for closing the switch to initiate an arc and to thereafter sustain the arc by continuing to connect the power supply to the output terminal after the ionizing circuit has fully discharged into the spark-generating device.

16. For a capacitive discharge ignition device, a method for generating and actively controlling an arc at a spark plug, the method comprising the steps of:

supplying energy to a capacitor of the device;

sensing a state of charge at the capacitor;

discharging the capacitor into the igniter plug to ionize an air gap of the plug; and continuing to pump energy into the spark plug after the capacitor has been discharged to sustain the arc for a predetermined time period, where the predetermined time period is longer than a time period the arc would be sustained solely by the discharging of the capacitor.

17. An apparatus for generating an arc at a spark generating device comprising:

an output terminal for connecting to a spark plug;

an ionizing circuit that delivers energy to the output terminal in the form of a first pair of voltages and currents, where the voltage is sufficient to ionize an air gap of the spark plug;

a switch that when closed connects the ionizing circuit and the output terminal and provides an electrically conductive path that communicates the energy of the ionizing circuit to the output terminal, which in turn delivers the energy to the connected spark plug, causing the air gap to ionize;

a power supply having on and off states for supplying energy to the output terminal and the connected spark plug in the form of a second pair of voltages and currents after ionization of the air gap by the first pair, where the voltages of the first pair are higher than the voltages of the second pair, and the currents of the second pair are higher than the currents of the first pair.

18. The apparatus of claim 17 wherein the second pair of voltages and currents is applied to the output terminal for a time period longer than a time period for which the first pair of voltages and currents is applied to the output terminal.

19. An apparatus for generating a sustained arc at a spark generating device comprising: an output terminal connecting to a spark generating device; a power converter having on and off states for selectively supplying energy to the spark generating device connected to the output terminal; an energy storage device for storing a voltage sufficient to ionize an air gap of the spark generating device; a switch for selectively transferring the voltage at the energy storage device to the spark generating device by way of the output terminal; a sensor associated with the energy storage device that monitors an amount of energy stored by the energy storage device; and, a logic circuit connected to the sensor, the switch, and the power converter for (1) switching the switch to a conducting state so that the energy stored in the energy storage device ionizes the air gap of the spark generating device and (2) controlling the power converter to pump energy to the output terminal to sustain a plasma arc at the air gap of the connected spark generating device for a predetermined time period after which the logic circuit switches the power converter to its off-state, where the logic circuit limits the energy delivered to the output terminal by the power converter until a center of the plasma arc generated at the air gap of the spark-generating device moves away from a tip of the spark generating device.

* * * * *